US009728352B2

(12) United States Patent
Chuang et al.

(10) Patent No.: US 9,728,352 B2
(45) Date of Patent: Aug. 8, 2017

(54) SWITCH STRUCTURE AND ELECTRONIC DEVICE USING THE SAME

(71) Applicant: HTC Corporation, Taoyuan County (TW)

(72) Inventors: I-Cheng Chuang, Taoyuan County (TW); Yu-Jing Liao, Taoyuan County (TW); Ying-Yen Cheng, Taoyuan County (TW); Chih-Wei Tu, Taoyuan County (TW); Hung-Wen Lin, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 177 days.

(21) Appl. No.: 14/153,090

(22) Filed: Jan. 13, 2014

(65) Prior Publication Data

US 2015/0200063 A1 Jul. 16, 2015

(51) Int. Cl.
*H01H 13/14* (2006.01)
*H01H 13/02* (2006.01)

(52) U.S. Cl.
CPC ..... *H01H 13/14* (2013.01); *H01H 13/02* (2013.01); *H01H 2207/04* (2013.01); *H01H 2239/052* (2013.01)

(58) Field of Classification Search
CPC .... H01H 13/02; H01H 13/04; H01H 2207/04; H01H 2239/052; H01H 13/14; H01H 13/702; H01H 13/705; H01H 13/78
USPC ..... 318/70, 71; 345/158–160; 200/512–517, 200/341–344, 5 A, 5 R, 4, 6 A
See application file for complete search history.

(56) References Cited

U.S. PATENT DOCUMENTS 6,995,326 B2 * 2/2006 Sugimura ..... H01H 25/041 200/5 R
7,721,609 B2 5/2010 Wright
8,390,481 B2 3/2013 Pance et al.
(Continued)

FOREIGN PATENT DOCUMENTS

CN 1296802 1/2007
CN 200969298 10/2007
(Continued)

OTHER PUBLICATIONS

"Office Action of Taiwan Counterpart Application", issued on Apr. 8, 2015, p. 1-p. 10.
(Continued)

*Primary Examiner* — Edwin A. Leon
*Assistant Examiner* — Ahmed Saeed
(74) *Attorney, Agent, or Firm* — Jianq Chyun IP Office

(57) ABSTRACT

A switch structure and an electronic device using the same are provided. The electronic device has a casing, and the switch structure is disposed at an inner side of the key portion of the casing. The switch structure includes an elastic member, a force transmission member and a strain sensor. The elastic member is connected to the casing. The force transmission member is located inside the casing. The strain sensor is disposed on the elastic member, and the strain sensor and the force transmission member are disposed are two opposite sides of the elastic member respectively. The elastic member is configured to be deformed by the force transmission member when an external force is applied to an outside of the key portion.

20 Claims, 4 Drawing Sheets

(56) References Cited

U.S. PATENT DOCUMENTS

| | | | | |
|---|---|---|---|---|
| 8,866,419 | B2 * | 10/2014 | Ippisch | A61B 17/1626 318/71 |
| 2006/0042924 | A1 * | 3/2006 | Ito | H01H 13/785 200/512 |
| 2007/0096666 | A1 * | 5/2007 | Ippisch | A61B 17/1626 318/71 |
| 2010/0318093 | A1 * | 12/2010 | Ippisch | A61B 17/1626 606/104 |
| 2012/0234659 | A1 * | 9/2012 | Huang | G05G 1/04 200/341 |

FOREIGN PATENT DOCUMENTS

| | | |
|---|---|---|
| CN | 103117178 | 5/2013 |
| CN | 103456541 | 12/2013 |
| EP | 0254966 | 2/1988 |
| JP | H09-222948 | 8/1997 |
| TW | 200928876 | 7/2009 |
| TW | M374098 | 2/2010 |
| TW | 201023017 | 6/2010 |

OTHER PUBLICATIONS

"Office Action of European Counterpart Application", issued on Dec. 9, 2014, p. 1-p. 5.
"Office Action of China Counterpart Application", issued on Jun. 1, 2016, p. 1-p. 7.
"Second Office Action of China Counterpart Application", issued on Dec. 8, 2016, p. 1-p. 7.

* cited by examiner

SWITCH STRUCTURE AND ELECTRONIC DEVICE USING THE SAME

BACKGROUND

Field of the Invention

The present application relates to a switch structure and an electronic device using the same, and in particular, to a switch structure with a seamless button design and an electronic device using the same.

Description of Related Art

In recent years, technology products mostly take mobility and functionality as the main appeal, and therefore the portable electronic devices, such as smart phones, tablet PCs, notebook computers and other products have become the mainstream of today's consumer electronics market.

In general, the portable electronic devices are usually equipped with physical buttons on the casing, and switch units corresponding to the keys are disposed in the casing. The physical buttons and the switch units are coupled to each other. A user can control the switch units by pressing the physical buttons, so as to switch the power, enable/disable Bluetooth or wireless network, adjust the volume, capture image, record video, or scroll display pages, etc. Typically, the casing of the portable electronic device requires corresponding openings thereon for installation of the physical buttons.

However, the aforementioned configuration restricts the available space inside the portable electronic device, and the assembling process is more complicated and causes difficulty in production, long production time and low assembling yields. On the other hand, dust, moisture may easily enter the electronic device through gaps between the physical buttons and the casing, which affects function of electronic components and shorten life time of the portable electronic device.

SUMMARY

The present application provides a switch structure and an electronic device using the same, which simplify the process steps, reduce the production time and save manufacturing cost. The switch structure and the electronic device allow the seamless design of the key to maintain the integrity of the appearance of the electronic device, and also prevent dust and moisture from entering the electronic device to ensure the life time and reliability of the electronic device.

The present application provides a switch structure adapted to an electronic device. The electronic device has a casing, and the switch structure is disposed at an inner side of a key portion of the casing. The switch structure comprises an elastic member, a force transmission member, and a strain sensor. The elastic member is connected to the casing, the force transmission member is disposed inside the casing, and the strain sensor is disposed on the force transmission member. The strain sensor and the force transmission member are located at two opposite sides of the elastic member respectively, and the elastic member is configured to be deformed by the force transmission member when an external force is applied to an outside of the key portion.

The present application also provides an electronic device comprising a body, a casing covering the body and having a key portion, and a switch structure disposed at an inner side of the key portion of the casing. The switch structure comprises an elastic member, a force transmission member, and a strain sensor. The force transmission member is disposed inside the casing, and the strain sensor is disposed on the force transmission member. The strain sensor and the force transmission member are located at two opposite sides of the elastic member respectively, and the elastic member is configured to be deformed by the force transmission member when an external force is applied to an outside of the key portion.

Based on the above, the present application provides the strain type switch structure at the inner side of the key portion of the casing, to perform key function as a user press the key portion of the casing. In other words, the present application accomplishes key function without additional openings on the casing of the electronic device for accommodating the physical keys or any other independent sensing device on the casing. Therefore, the process steps can be simplified, the production time can be reduced, the production cost can be saved, and the assembly yield can be improved. Furthermore, the seamless key design can be adopted on the electronic device, wherein no gap is formed between the casing and the keys, not only to maintain the integrity of the appearance of the electronic device, but also prevent the dust or moisture from entering the electronic device, to ensure the life time and reliability of the electronic device.

In order to make the aforementioned and other features and advantages of the present application more comprehensible, several embodiments accompanied with figures are described in detail below.

DESCRIPTION OF THE EMBODIMENTS

Figure 1:
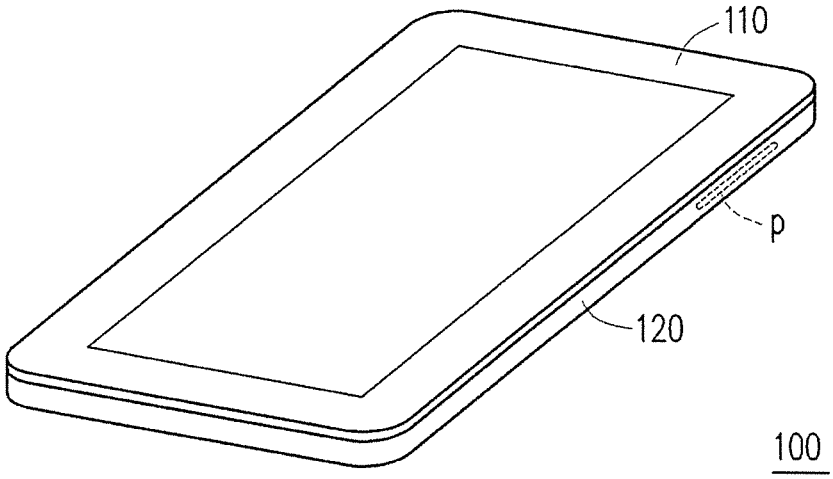
FIG. 1 is a perspective view illustrating an electronic device according to an embodiment of the present application.
Figure 2:
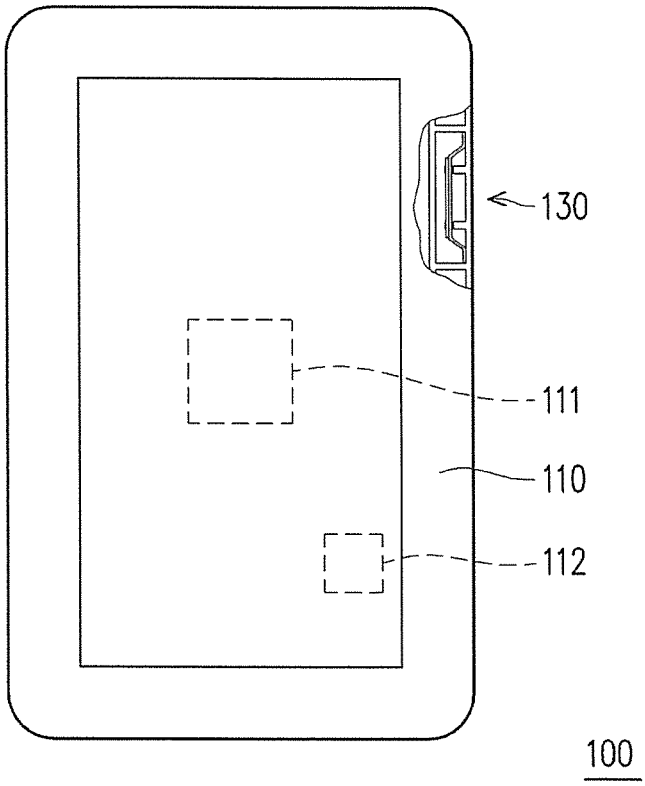
FIG. 2 is a top view illustrating the electronic device of FIG. 1.

FIG. 1 is a perspective view illustrating an electronic device according to an embodiment of the present application. FIG. 2 is a top view illustrating the electronic device of FIG. 1. Referring to FIG. 1 and FIG. 2, in the present embodiment, the electronic device 100 includes a body 110, a casing 120 and a switch structure 130, wherein the electronic device 100 may be, for example, Smart phone, PDA, tablet computer or Ebook reader, and the casing 120 may be, for example, plastic casing, carbon fiber casing, or a composite casing comprising plastic and metal.

Figure 3:
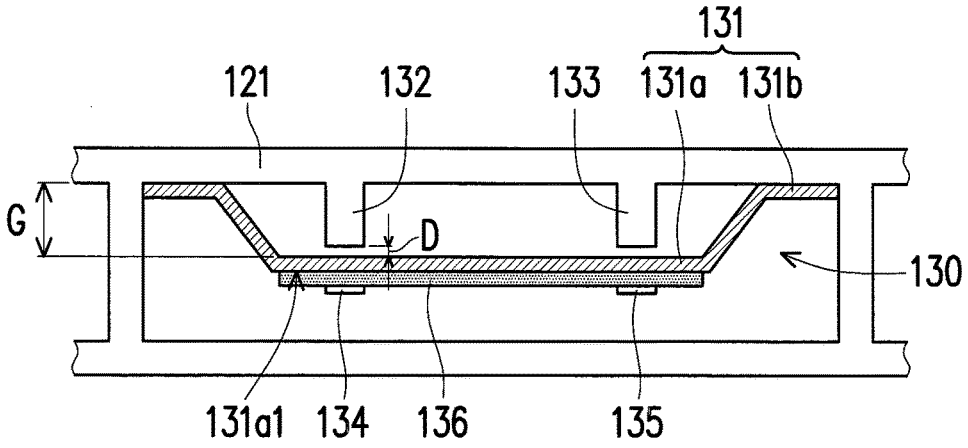
FIG. 3 is a schematic diagram illustrating a switch structure depicted in FIG. 2.

FIG. 3 is a schematic diagram illustrating a switch structure depicted in FIG. 2. Referring to FIG. 1 through FIG. 3, in the present embodiment, the casing 120 covers the body 110 and has a key portion 121. The switch structure 130 is disposed at an inner side of the key portion 121 of the casing 120. Specifically, the switch structure 130 includes an elastic member 131, a first force transmission member 132, a second force transmission member 133, a first strain sensor 134 and a second strain sensor 135, wherein the elastic member 131 is made of steel or other material with good ductility, and the first strain sensor 134 and a second strain sensor 135 are, for example, strain gauges.

The elastic member 131 includes a deforming portion 131*a* and a connecting portion 131*b* in structure. The deforming portion 131*a* located at a distance away from the casing 120 to form a gap G, wherein the deforming portion 131*a* may be flat and parallel to the key portion 121. The connecting portion 131*b* is connected between the deforming portion 131*a* and the casing 120, wherein the connecting portion 131*b* and the casing 120 are welded with each other, for example. The first force transmission member 132 and a second force transmission member 133 are disposed inside the casing 120 together and are located in the gap G, wherein the first force transmission member 132 and the second force transmission member 133 may be disposed on the casing 120, such as integrally formed with the casing 120 and protruding from the key portion 121. On the other hand, the first strain sensor 134 and a second strain sensor 135 in pairs are disposed on the surface 131*a*1 of the deforming portion 131*a* of the elastic member 131. And, the first strain sensor 134 and the first force transmission member 132 are located at a side of the deforming portion 131 *a*, and the second strain sensor 135 and the second force transmission member 133 are located at another side thereto, wherein a key region P is provided on the outside of the key portion 121.

In the present embodiment, the switch structure 130 further includes a flexible printed circuit board (FPC) 136, wherein the first strain sensor 134 and a second strain sensor 135 are electrically connected to the FPC 136, respectively. That is, the first strain sensor 134 and a second strain sensor 135 are disposed on the surface 131*a*1 of the deforming portion 131*a* through the FPC 136. The FPC 136 may be bonded to the elastic member 131 through welding.

Figure 4:
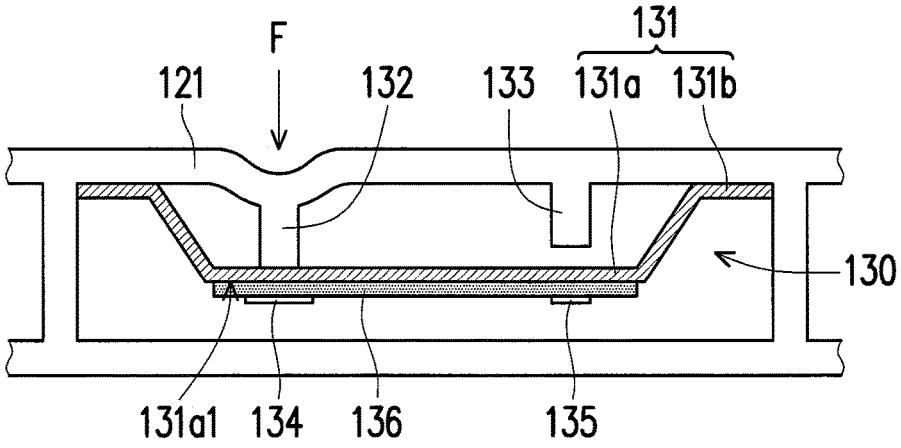
FIG. 4 is a schematic diagram illustrating the operation of the switch structure of FIG. 3.

FIG. 4 is a schematic diagram illustrating the operation of the switch structure of FIG. 3. Referring to FIG. 1, FIG. 2 and FIG. 4, when an external force F is applied to the outside of the key portion 121, such as when the external force F is applied by a user to the key region P, the deforming portion 131*a* is deformed by the first force transmission member 132. In detail, when the user applies the external force F on the key region P, the key portion 121 is deformed in part, and the first force transmission member 132 moves toward and contacts the deforming portion 131*a*. As the deforming portion 131*a* is deformed by the first force transmission member 132, the FPC 136 and the first strain sensor 134 on the deforming portion 131*a* are thereby deformed and forms a stretched state, therefore circuit lines of the first strain sensor 134 are become narrower and longer, such that variation of resistance of the first strain sensor 134 occurs, and the voltage signal passing through the first strain sensor 134 varies accordingly.

On the other hand, the body 110 includes a control unit 111 and a vibration unit 112, wherein the vibration unit 112, the first strain sensor 134 and the second strain sensor 135 are electrically connected to the control unit 111, respectively. When the body 110 detects the variation of the voltage signal, the control unit 111 disposed in the body 110 may produce a control signal according to the variation of the said voltage signal, wherein the control signal may be power switch signal, volume adjustment signal or screen scroll signal, etc. After receiving the control signal, electronic components of the electronic device 100 are enabled to perform corresponding functions. Another control signal, such as a vibration signal, may be produced by the control unit 111 according to the variation of the said voltage signal. And then, the vibration unit 112 is enabled to provide a vibration feedback to the user after receiving said another control signal.

It is noted that, in an embodiment not shown, the deforming portion 131 *a* may be deformed by the external force F through the second force transmission member 133 as well. Specifically, as the deforming portion 131*a* is deformed through the second force transmission member 133, a variation of resistance due to the deformation of the second strain sensor 135 occurs, wherein the operation of the second strain sensor 135, the generation of the control signal, and the corresponding reaction of the electronic components of the body 110 can be described with reference to the illustration of the first strain sensor 134, and are not repeated herein. In an embodiment of the present application, for example, functions of turning on the power, amplifying the volume or scrolling up the screen can be performed with the deformation of the first strain sensor 134, while the deformation of the second strain sensor 135 actuates the functions of turning off the power, decreasing the volume or scrolling down the screen as compared to the function of the first strain sensor 135.

By this manner, the key portion 121 of the casing 120 and the switch structure 130 may integrate a virtual key to perform functions as a conventional physical key does. In other words, since there requires no opening on the casing 120 for accommodating any physical key, the production process can be simplified, the production time can be reduced, the production cost can be saved, and the assembly yield rate can be improved. Due to the seamless key design can be adopted on the electronic device 100, no gap is formed between the casing and the key regions (virtual keys), not only to maintain the integrity of the appearance of the electronic device, but also prevent the dust or moisture from entering the electronic device, to ensure the life time and reliability of the electronic device.

Furthermore, in order to improve the convenience of operation, identification patterns can be formed in the key region P, wherein the identification patterns includes common used symbols, such as an arrow, or a surface with texture variations, such as an uneven or rough surface. By which, the user can perceive the location of the key region P through vision or touching manner, and accurately press the key portion 121 to accomplish the desired functions. Specifically, the stiffness of the key portion 121 of the casing 120 is less than the stiffness of other adjacent portions of the casing 120; that is, when the external force F is applied on the key portion 121 and other adjacent portions of the casing 120, the key portion 121 generates a larger deformation than that of the other adjacent portions, to effectively actuate the first force transmission member 132 and the second force transmission member 133 for deforming the first strain sensor 134 and the second strain sensor 135. Thereby, obvious variation of resistance of the first strain sensor 134 and the second strain sensor 135 can be obtained.

Since the key functions of the first strain sensor 134 and the second strain sensor 135 are likely triggered unexpectedly due to a minor deformation caused by the force from the user gripping or picking up the electronic device 100, the first force transmission member 132 and the second force transmission member 133 are located at a distance D away from the deforming portion 131*a*, respectively, as shown in FIG. 3. By which, the distance D provides a buffer to the unexpected deformation, to prevent the electronic device 100 from malfunction.

Figure 5:
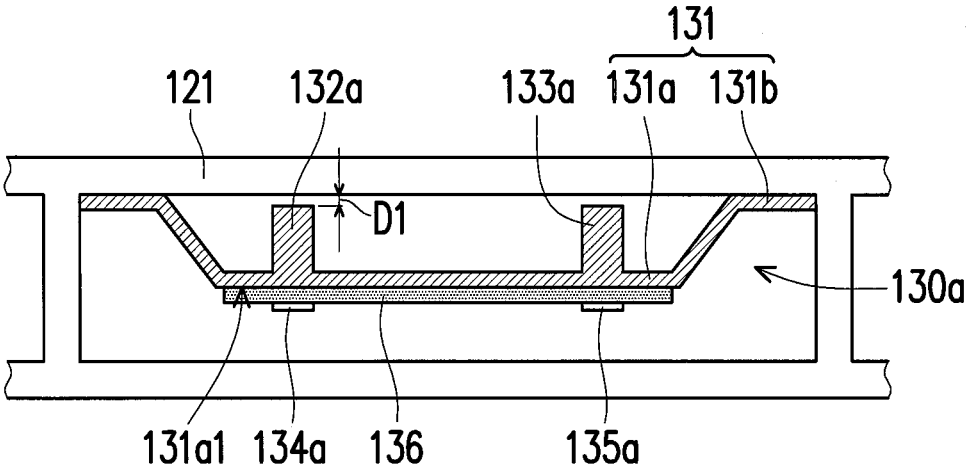
FIG. 5 is a schematic diagram illustrating a switch structure according to another embodiment of the present application.
Figure 6:
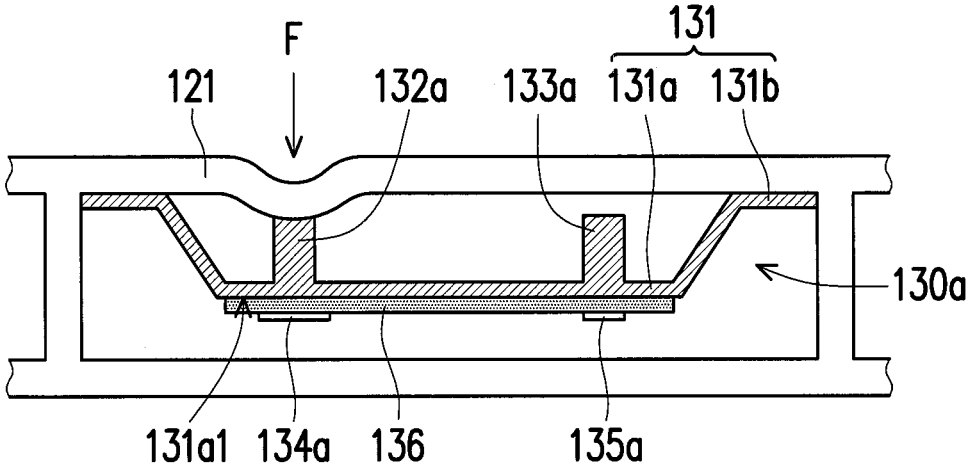
FIG. 6 is a schematic diagram illustrating the operation of the switch structure of FIG. 5.

FIG. 5 is a schematic diagram illustrating a switch structure according to another embodiment of the present application. FIG. 6 is a schematic diagram illustrating the operation of the switch structure of FIG. 5. Referring to the FIG. 5 and FIG. 6, in the present embodiment, the first force transmission member 132*a* and the second force transmission member 133*a* of the switch structure 130*a* are formed on the deforming portion 131*a* of the elastic member 131, such as integrally formed with the elastic member 131 as a one-piece article. And, the first force transmission member 132*a* and the second force transmission member 133*a* are located at a distance D1 away from the inner side of the key portion 121. Therefore, when the user applies an external force F on the key region P, a partial portion of the key portion 121 is deformed and leans against the first force transmission member 132*a* or the second force transmission member 133*a* (here, as an example, the partial portion of the key portion 121 leans against the first force transmission member 132*a*). At this time, the deforming portion 131 a is deformed by the external force F through the first force transmission member 132*a* or the second force transmission member 133*a*. As the deforming portion 131 a is deformed, the first strain sensor 134*a* (or the second strain sensor 135*a*) disposed on the deforming portion 131*a* is accordingly deformed in a stretched state, such that variation of resistance of the first strain sensor 134*a* (or the second strain sensor 135*a*) is generated. Wherein, the operation of the first strain sensor 134*a* or the second strain sensor 135*a*, the generation of the control signal, and the corresponding reaction of the electronic components of the body 110 can be described with reference to the above embodiment, and are not repeated herein.

Figure 7:
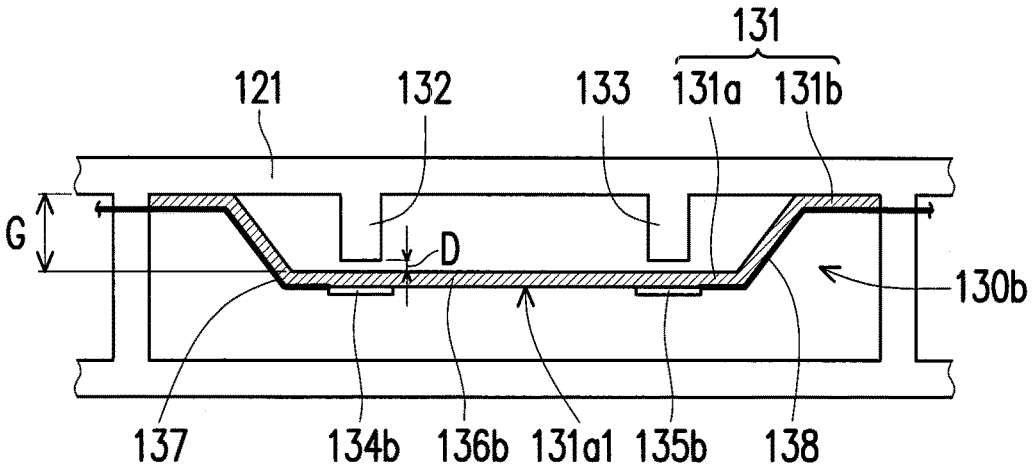
FIG. 7 is a schematic diagram illustrating a switch structure according to further another embodiment of the present application.
Figure 8:
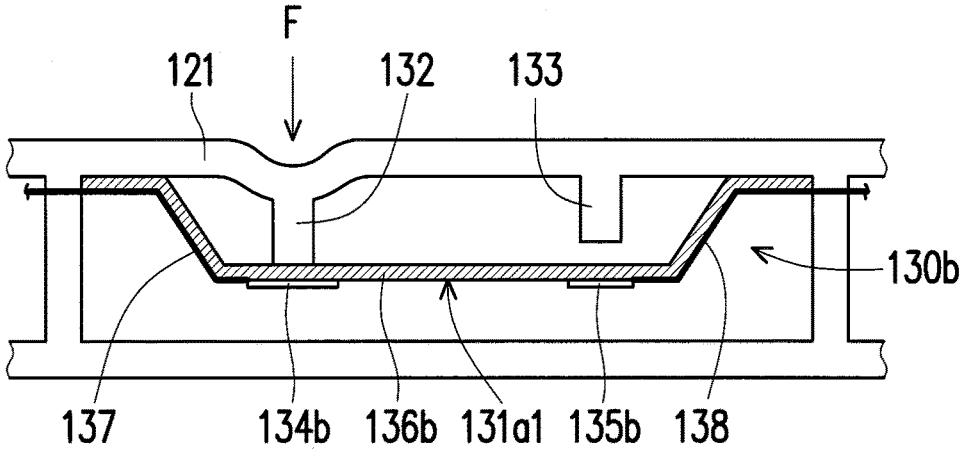
FIG. 8 is a schematic diagram illustrating the operation of the switch structure of FIG. 7.

FIG. 7 is a schematic diagram illustrating a switch structure according to further another embodiment of the present application. FIG. 8 is a schematic diagram illustrating the operation of the switch structure of FIG. 7. Referring to FIG. 7 and FIG. 8, in the present embodiment, the difference between the switch structure 130*b* and the switch structure 130 in FIG. 3 includes that the switch structure 130*b* is provided without the FPC 136 on the surface 131*a*1 of the deformation portion 131*a* of the switch structure 130. Herein, the first strain sensor 134*b* or the second strain sensor 135*b* is directly disposed on the surface 131*a*1 of the deformation portion 131*a*, wherein the elastic member 131 may be made of flexible plastic material. On the other hand, the switch structure 130*b* further includes wires 137 and 138, wherein the wire 137 may be electrically coupled among the first strain sensor 134*b*, the control unit 111 (as shown in FIG. 2) and the vibration unit 112 (as shown in FIG. 2); while the wire 138 may be electrically coupled among the second strain sensor 135*b*, the control unit 111 (as shown in FIG. 2) and the vibration unit 112 (as shown in FIG. 2). Wherein, the principle of operation of the first strain sensor 134*b* or the second strain sensor 135*b*, the generation of the control signal, and the corresponding reaction of the electronic components of the body 110 can be described with reference to the above embodiment, and are not repeated herein.

Alternatively, in replacement to the first force transmission member 132 and the second force transmission member 133 formed on the casing 120 as described in the present embodiment, the first force transmission member 132*a* and the second force transmission member 133*a* formed on the deformation portion 131*a* of the elastic member 131 as illustrated in FIG. 5 can also be applied to the switch structure 130*b*, and the present invention provides no limitation thereto.

Although the above embodiments are described with the first force transmission member and the second force transmission member disposed in pairs, as well as the first strain sensor and the second strain sensor; however, in other embodiments which are not shown, only one force transmission member and one strain sensor can be used according to the actual design requirements, to perform the functions of power switching, volume adjusting or screen scrolling, etc.. Furthermore, with integration design of multi-function keys, the number of the force transmission member or the strain sensor can be three, four, or more, to perform desired key functions.

On the other hand, except the manner of maintaining distance between the force transmission member and the deformation portion or between the force transmission member and the key portion to prevent the malfunction of the electronic device as described in the above embodiments, malfunctioning the electronic device can be further prevented by setting a threshold value of the strain sensor, such as a threshold value for deformation of the strain sensor, etc.. Specifically, an external force applied by the user gripping or picking up the electronic device may cause a minor deformation of the strain sensor, and a variation of the resistance causes the voltage signal passing through the strain sensor varying accordingly. However, when the deformation of the strain sensor does not exceed the threshold value, the variation of the voltage signal may not make the control unit generate the control signal. In other words, through the aforementioned manner, even if the force transmitting member configured to be contact with the deformation portion and the key portion in an original state, unexpected malfunction of the electronic device can still be effectively avoided.

To sum up, the present application provides a strain switch structure at an inner side of a key portion of a casing to perform key functions when a user presses the key portion. In other words, the present application accomplishes the key functions without any additional opening on the casing for accommodating the physical keys or any other independent sensing unit on the casing. Therefore, the production process is simplified, the production time is reduced, the production cost is decreased, and the assembly yield rate is improved. Due to the seamless key design can be adopted on the electronic device, no gap is formed between the casing and the keys, not only to maintain the integrity of the appearance of the electronic device, but also prevent the dust or moisture from entering the electronic device, to ensure the life time and reliability of the electronic device. In order to improve the convenience of operation, identification patterns can be formed in the key region P; by which, the user can perceive the location of the key region through vision or touching manners. Besides, the occurrence of unexpected malfunction can be prevented by keeping a distance between the force transmission member and the deformation portion or between the force transmission member and the key portion, or setting a threshold value for the strain sensor, such as a threshold value of the deformation of the strain sensor, etc.

It will be apparent to those skilled in the art that various modifications and variations can be made to the structure of the present application without departing from the scope or spirit of the application. In view of the foregoing, it is intended that the present application cover modifications and variations of this application provided they fall within the scope of the following claims and their equivalents.

What is claimed is:

1. A switch structure adapted to an electronic device, wherein the electronic device has a casing, and the switch structure is disposed at an inner side of a key portion integrally formed in the casing, the switch structure comprising:

an elastic member, connected to the key portion integrally formed in the casing;

a force transmission member, disposed inside the key portion integrally formed in the casing; and a strain sensor, attached onto the elastic member, and the strain sensor and the force transmission member are located at two opposite sides of the elastic member respectively, wherein the elastic member is configured to be deformed by the force transmission member when an external force is applied to an outside of the key portion, and the strain sensor is deformed due to deformation of the elastic member such that a variation of resistance of the strain sensor occurs.

2. The switch structure according to claim 1, wherein the elastic member comprises:

a deforming portion, located at a distance away from the key portion integrally formed in the casing to form a gap, the strain sensor being disposed on a surface of the deforming portion; and a connecting portion, connecting the deforming portion and the key portion integrally formed in the casing.

3. The switch structure according to claim 2, wherein the deforming portion of the elastic member is flat and is parallel to the key portion.

4. The switch structure according to claim 2, wherein the force transmission member is formed on the elastic member and protruding from the deformed portion.

5. The switch structure according to claim 4, wherein the force transmission member and the elastic member are integrally formed.

6. The switch structure according to claim 2, further comprising a flexible printed circuit board electrically connected to the strain sensor, wherein the strain sensor is disposed on the surface of the deforming portion through the flexible printed circuit board.

7. The switch structure according to claim 2, wherein the number of the strain sensor is two, and the number of the force transmission member is two, the two strain sensors are disposed on the elastic member, the two force transmission members are disposed in the gap, and a key region is provided on the outside of the key portion.

8. The switch structure according to claim 1, wherein the force transmission member is formed on the casing and protruding from an inner side of the key portion.

9. The switch structure according to claim 8, wherein the force transmission member and the casing are integrally foamed as one-piece.

10. An electronic device, comprising:

a body;

a casing, covering the body and having a key portion integrally formed therein; and a switch structure, disposed at an inner side of the key portion integrally formed in the casing, the switch structure comprising:

an elastic member, connected to the key portion integrally formed in the casing;

a force transmission member, disposed inside the key portion integrally formed in the casing; and a strain sensor, attached on the elastic member, and the strain sensor and the force transmission member are located at two opposite sides of the elastic member respectively, wherein the elastic member is configured to be deformed by the force transmission member when an external force is applied to an outside of the key portion, and the strain sensor is deformed due to deformation of the elastic member such that a variation of resistance of the strain sensor occurs.

11. The electronic device according to claim 10, wherein the elastic member comprises:

a deforming portion, located at a distance away from the key portion integrally formed in the casing to form a gap, the strain sensor being disposed on a surface of the deforming portion; and a connecting portion, connecting the deforming portion and the key portion integrally formed in the casing.

12. The electronic device according to claim 11, wherein the deforming portion of the elastic member is flat and is parallel to the key portion.

13. The electronic device according to claim 11, wherein the transmission member is formed on the elastic member and protruding from the deformed portion.

14. The electronic device according to claim 13, wherein the force transmission member and the elastic member are integrally formed as a one-piece article.

15. The electronic device according to claim 11, wherein the switch structure further comprises a flexible printed circuit board electrically connected to the strain sensor, and the strain sensor is disposed on the surface of the deforming portion through the flexible printed circuit board.

16. The electronic device according to claim 11, wherein the number of the strain sensor is two, and the number of the force transmission member is two, the two strain sensors are disposed on the elastic member, and the two force transmission members are disposed in the gap, and a key region is provided on the outside of the key portion.

17. The electronic device according to claim 10, wherein the force transmission member is formed on the casing and protruding from the key portion.

18. The electronic device according to claim 17, wherein the force transmission member and the casing are integrally formed as a one-piece article.

19. The electronic device according to claim 10, wherein a stiffness of the key portion of the casing is less than a stiffness of other adjacent portions of the casing.

20. The electronic device according to claim 10, wherein the body comprises a control unit and a vibration unit, the vibration unit and the strain sensor are electrically connected to the control unit respectively, and the control unit is adapted to enable the vibration unit according to a voltage signal from the strain sensor.

* * * * *